US005720197A

United States Patent [19]

Grau et al.

[11] Patent Number: 5,720,197

[45] Date of Patent: Feb. 24, 1998

[54] CRIMPER ASSEMBLY

[75] Inventors: Jeffrey M. Grau, Toledo, Ohio; Scott C. May, Jackson; Robert A. Laipply, Spring Arbor, both of Mich.

[73] Assignees: Aeroquip Corporation, Maumee, Ohio; Lomar Machine and Tool Company, Horton, Mich.

[21] Appl. No.: 810,185

[22] Filed: Mar. 3, 1997

Related U.S. Application Data

[60] Provisional application No. 60/013,060, Mar. 8, 1996, and provisional application No. 60/036,084, Jan. 16, 1997.

[51] Int. Cl.[6] ..... B21D 39/04

[52] U.S. Cl. ..... 72/402; 72/454

[58] Field of Search ..... 72/402, 461, 454, 72/416, 412; 29/237, 282, 283.5

[56] References Cited

U.S. PATENT DOCUMENTS

| | | | |
|---|---|---|---|
| 4,785,656 | 11/1988 | Kennedy | 29/237 |
| 5,257,525 | 11/1993 | Clarke | 72/402 |
| 5,353,623 | 10/1994 | Bobenhausen | 72/402 |

FOREIGN PATENT DOCUMENTS

| | | | |
|---|---|---|---|
| 710088 | 5/1965 | Canada | 72/402 |
| 285568 | 11/1993 | Japan | 72/402 |

*Primary Examiner*—Daniel C. Crane

*Attorney, Agent, or Firm*—Emch, Schaffer, Schaub & Porcello, Co., L.P.A.

[57] ABSTRACT

A crimper assembly for crimping a workpiece such as a hose fitting is disclosed. The crimper assembly includes a pair of tie rods of differing diameters which mount a lower stationary die carriage and an upper movable die carriage. A central rod is mounted on the movable carriage and extends through a press bar. A driving force is applied to the central rod by a cylinder in one embodiment and by a tool, such as an impact wrench in another embodiment. Die retainer plates are attached to the carriages and include guide slots. Tongues are provided on flexible die set retainers which are received in the guide slots. A spring biased disconnect plate is slidably attached to the tie rods adjacent the press bar. When the disconnect plate is moved to a disconnect position, the movable carriage can be moved upwardly for access to the flexible die set retainers for changing individual dies.

9 Claims, 7 Drawing Sheets

CRIMPER ASSEMBLY

RELATED APPLICATION

The present application is related to a first Provisional application Ser. No. 60/013,060 filed Mar. 8, 1996 and to a second Provisional application Ser. No. 60/036,084 filed Jan. 16, 1997.

BACKGROUND OF THE INVENTION

The present invention relates to a crimper assembly or crimper machine for crimping a workpiece, for example, crimping a fitting ferrule to a hose. Crimping assemblies or crimping machines for crimping fittings to hoses are well known in the art. One such prior art crimper is disclosed in U.S. Pat. No. 5,257,525. Other types of crimping assemblies or crimping machines are shown in prior art U.S. Pat. Nos. 4,034,592; 4,034,593; 4,400,967; and 4,785,656.

The present crimper assembly is particularly useful in crimping hose fittings in the field. Sometimes it is necessary to connect, for example, a hose fitting ferrule to a flexible hose which is designed to carry gases. In this situation, it is important that the crimper assembly be capable of providing a tight sealed crimp which does not release gas to the atmosphere.

One problem in prior art crimper machines was the difficulty in disassembling the crimper assembly or crimper machine to quickly replace the die segments, when necessary. This is often necessary where various diameter fittings or fitting ferrules are being crimped and the dies or die segments must be quickly replaced.

One object of the present invention is to provide an improved crimper assembly which is readily disassembled for the interchange of the die sets.

SUMMARY OF THE INVENTION

The present invention is directed to a crimper machine or crimper assembly for crimping a workpiece, such as a hose fitting ferrule to a hose. The crimping assembly includes a pair of tie rods having different diameters which mount a lower stationary die carriage and an upper moveable die carriage. A central rod is mounted on the moveable carriage and extends through a press bar. A driving force is applied to the central rod by either a cylinder or by an impact wrench to a screw, connected to the central rod.

Die retainer plates are attached adjacent receiving cavities defined by the carriages and include guide slots. Tongues are provided on flexible die set retainers which are positioned within the receiving cavities. When in the correct position, the tongues extend into the guide slots and hold the die set retainers in their correct position.

A spring biased disconnect plate is slidably attached to the tie rods adjacent the press bar. When the disconnect plate is moved to a disconnect position, the movable carriage can be moved along the tie rods for access to the flexible die set retainers and the die sets.

DESCRIPTION OF THE PREFERRED EMBODIMENTS

Figure 1:
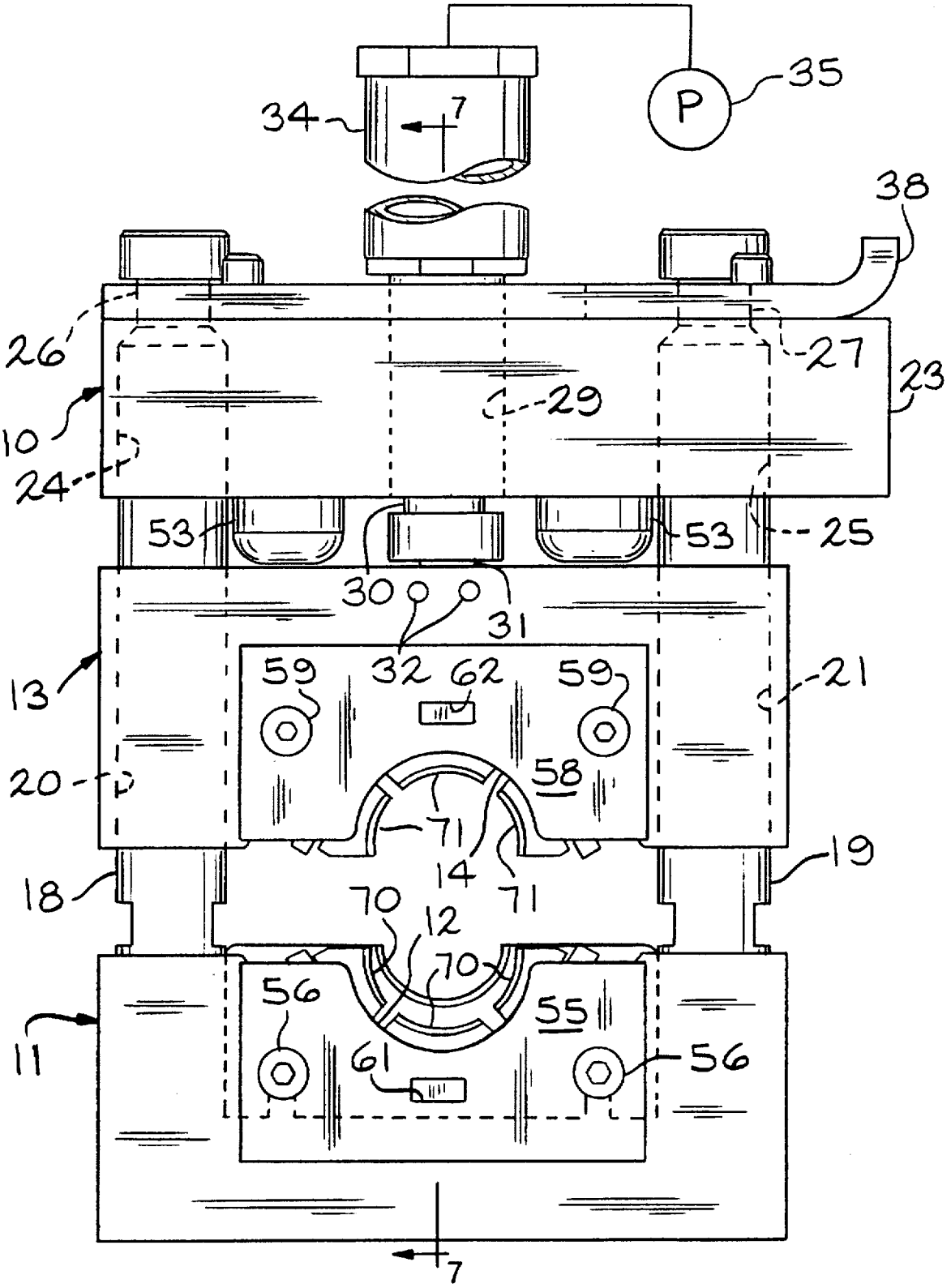
FIG. 1 is a front elevational view of a crimper assembly, according to the present invention.

Referring to the drawings, a crimper machine, according to the present invention, is generally indicated by the reference number 10. The crimper machine or crimper assembly 10 includes a lower stationary die carriage 11 having a pocket 12 and an upper moveable die carriage 13 having a mating pocket 14.

The stationary die carriage 11 includes spaced apart first and second receiving cavities 16 and 17 which receive and mount the lower ends of a pair of parallel tie rods 18 and 19. Preferably, the tie rod 19 has a larger outer diameter than does the tie rod 18. The movable die carriage 13 has spaced apart passageways 20 and 21 for slideably receiving the tie rods 18 and 19. The passageway 21 being of a slightly larger diameter than the passageway 20. The difference in diameter of the passageways 20 and 21 and the corresponding tie rod diameters 18 and 19 ensure that when the slidable, moveable die carriage 13 is removed from the tie rods 18 and 19, for example, when the die sets are removed, the moveable die carriage 13 is not improperly reversed when it is repositioned on the tie rods 18 and 19.

A press bar 23 defines openings 24 and 25 which receive the upper ends of the tie rods 18 and 19. The upper ends of the tie rods 18 and 19 define reduced diameter portions 26 and 27. The press bar 23 also defines a central aperture 29 which receives a central rod 30. The bottom of the central rod 30 has an attachment end 31 which is secured to the moveable die carriage 13 by roll pins 32. The upper end of the central rod 30 is operatively connected to the rod of a cylinder 34. In the present embodiment, the cylinder 34 is a hydraulic cylinder and is supplied by a hydraulic pump 35. In other embodiments, the central rod 30 is driven by an air cylinder (not shown) or by a screw as discussed subsequently.

Figure 3:
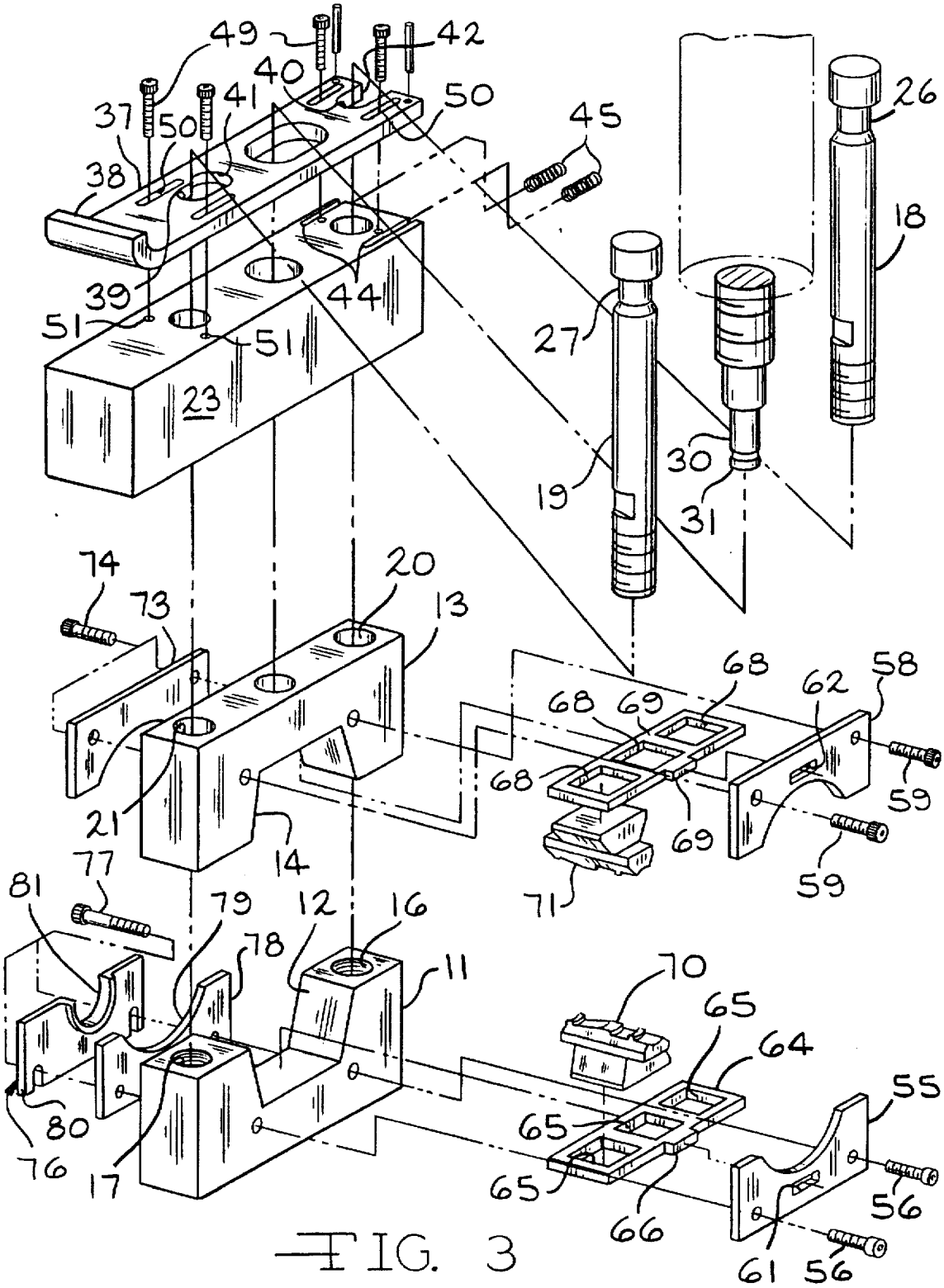
FIG. 3 is an exploded view of the crimper assembly shown in FIG. 1.
Figure 4:
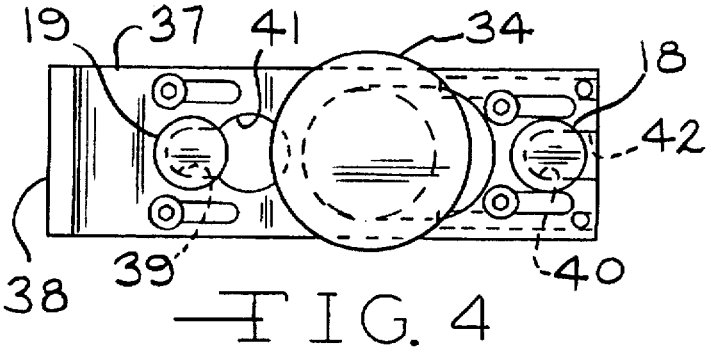
FIG. 4 is a top elevational view of the crimper assembly shown in FIG. 2, shown on a reduced scale.
Figure 5:
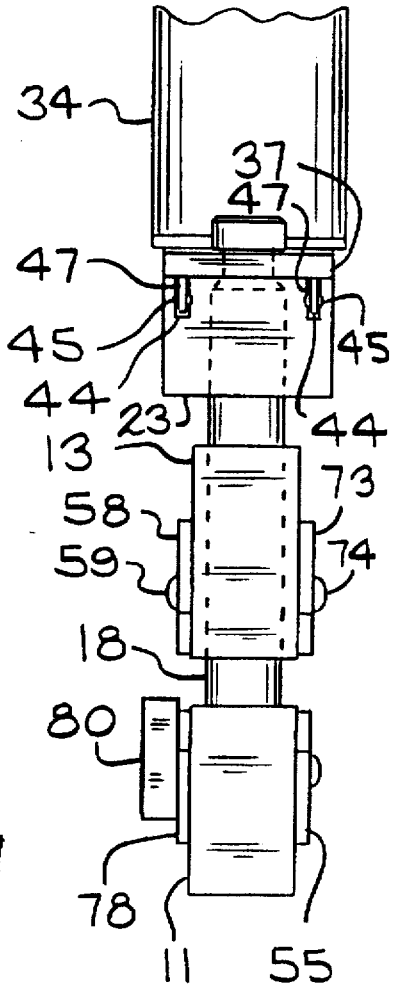
FIG. 5 is a fragmentary right end view of the crimper assembly shown in FIG. 2.

A disconnect plate 37 is slideably mounted adjacent the top of the press bar 23. The disconnect plate 37 has an upturned end 38 which is used to grasp the plate 37 for movement. Referring to FIG. 3, the disconnect plate 37 also defines first openings 39 and 40 which are complementary with and receive the reduced diameter portions 27 and 26 of the tie rods 19 and 18. A second connected and larger opening 41 extends from the first opening 39 and a second larger opening 42 which is a connected end slot extends from the first opening 40. When the crimper assembly 10 is in its operating position, the disconnect plate 37 is positioned so that the first openings 39 and 40 receive the complementary reduced diameter portions 27 and 26 of the tie rods 19 and 18. When it is desirable to remove the moveable die carriage 13, the upturned end 38 is grasped and the disconnect plate 37 is moved to align the tie rods with the second opening 41 and the second opening or end slot 42. The moveable die carriage 13 can then be removed from the tie rods 18 and 19. This operation is normally used when the die sets are changed.

Figure 6:
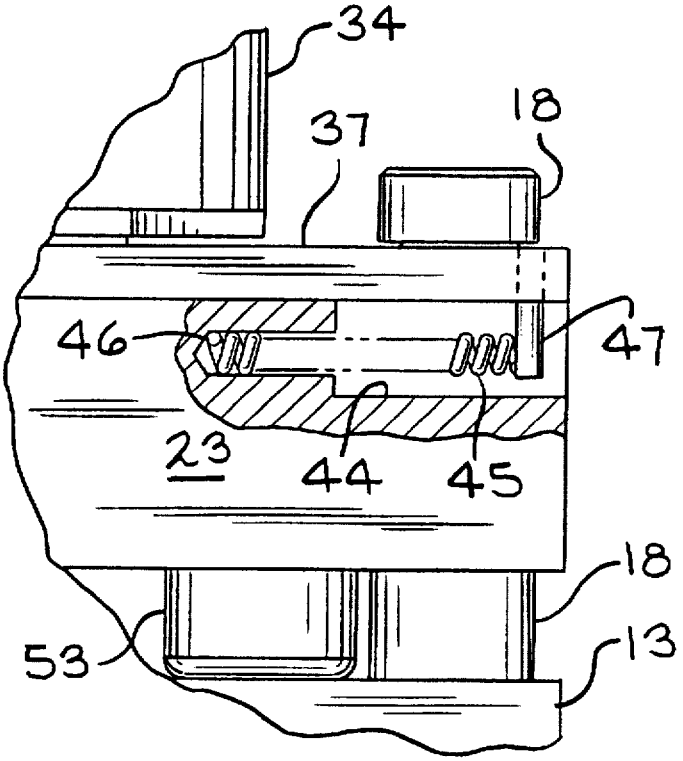
FIG. 6 is a fragmentary rear elevational view of the crimper assembly shown in FIG. 2 with a portion shown in cross-section.

Referring to FIGS. 3 and 6, the upper surface of the press bar 23 defines a pair of parallel slots 44 which receive springs 45. One end of each of the springs is connected to the press bar 23 by pins 46 and the other end is connected to the disconnect plate 37 by pins 47. The springs 45 act as a spring assembly which is operatively connected between the disconnect plate 37 and the press bar 23 to urge the disconnect plate 37 to the crimper assembly operating position wherein the first openings 39 and 40 within the disconnect plate 37 receive and are aligned with the reduced diameter portions 26 and 27 of the tie rods 18 and 19.

The disconnect plate 37 is slidably positioned on the press bar 23 by a plurality of cap screws 49 which extend through a plurality of longitudinally extending slots 50 in the disconnect plate 37 and are received in threaded openings 51 in the top of the press bar 23.

In the present embodiment, elastomeric bumpers 53 are mounted on the bottom of the press bar 23, as shown in FIG. 1. As the moveable die carriage moves upwardly when the central rod 30 is retracted, the moveable die carriage 13 can engage the bumpers 53.

Figure 2:
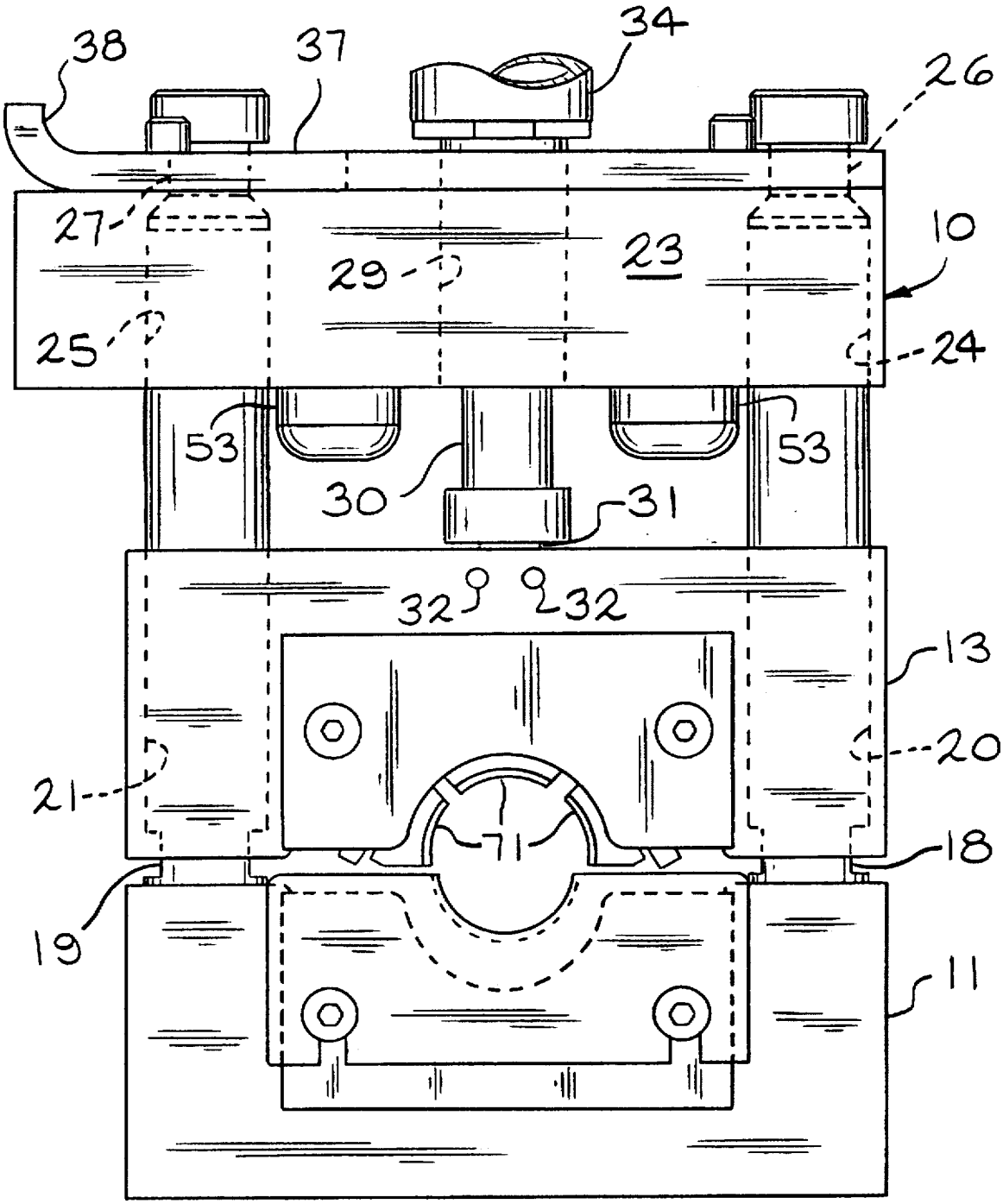
FIG. 2 is a rear elevational view of the crimper assembly shown in FIG. 1, with the movable die carriage moved to its down position.

Referring to FIGS. 1–3, a first die set retainer plate 55 is attached to the stationary die carriage 11 by cap screws 56. A second die set retainer plate 58 is attached to the moveable die carriage 13 by cap screws 59. An important feature of the crimper assembly 10 is that the first die set retainer plate 55 defines a guide slot 61 and the second die set retainer plate 58 defines a guide slot 62.

A first flexible die set retainer 64 is positioned within the pocket 12 of the stationary die carriage 11 and includes a plurality of openings 65 and an outwardly extending tongue 66. Similarly, a second flexible retainer 67 having a plurality of openings 68 and an outwardly extending tongue 69 is positioned within the pocket 14 of the moveable die carriage 13. The first and second flexible retainers 64 and 67 are preferably constructed of a flexible plastic material and their openings 65 and 68 receive a plurality of individual die sets 70 and 71. The tongues 66 and 69 are received in the guide slots 61 and 62, respectively. If the respective die sets 70 and 71 are prepositioned in the first and second flexible retainers 64 and 67, the die sets 70 and 71 may be quickly removed and replaced as entire sets when a new size is required. It has been found that the guide slot and tongue system makes the interchanging of die sets more efficient than what was known in the prior art.

In some embodiments, not shown, die set retainer plates similar to the plates 55 and 58 are positioned on the opposite sides of the stationary die carriage 11 and moveable die carriage 13. However, in the present embodiment, a die set retainer plate 73 is mounted by cap screws 74 to the opposite side of the moveable die carriage 13. A stop plate assembly 76 is mounted by cap screws 77 to the opposite side of the stationary die carriage 11. The stop assembly 76 includes an inner plate 78 having a recess 79 and an outer plate 80 having a curved portion 81 for supporting a workpiece during the crimping operation.

Figure 7:
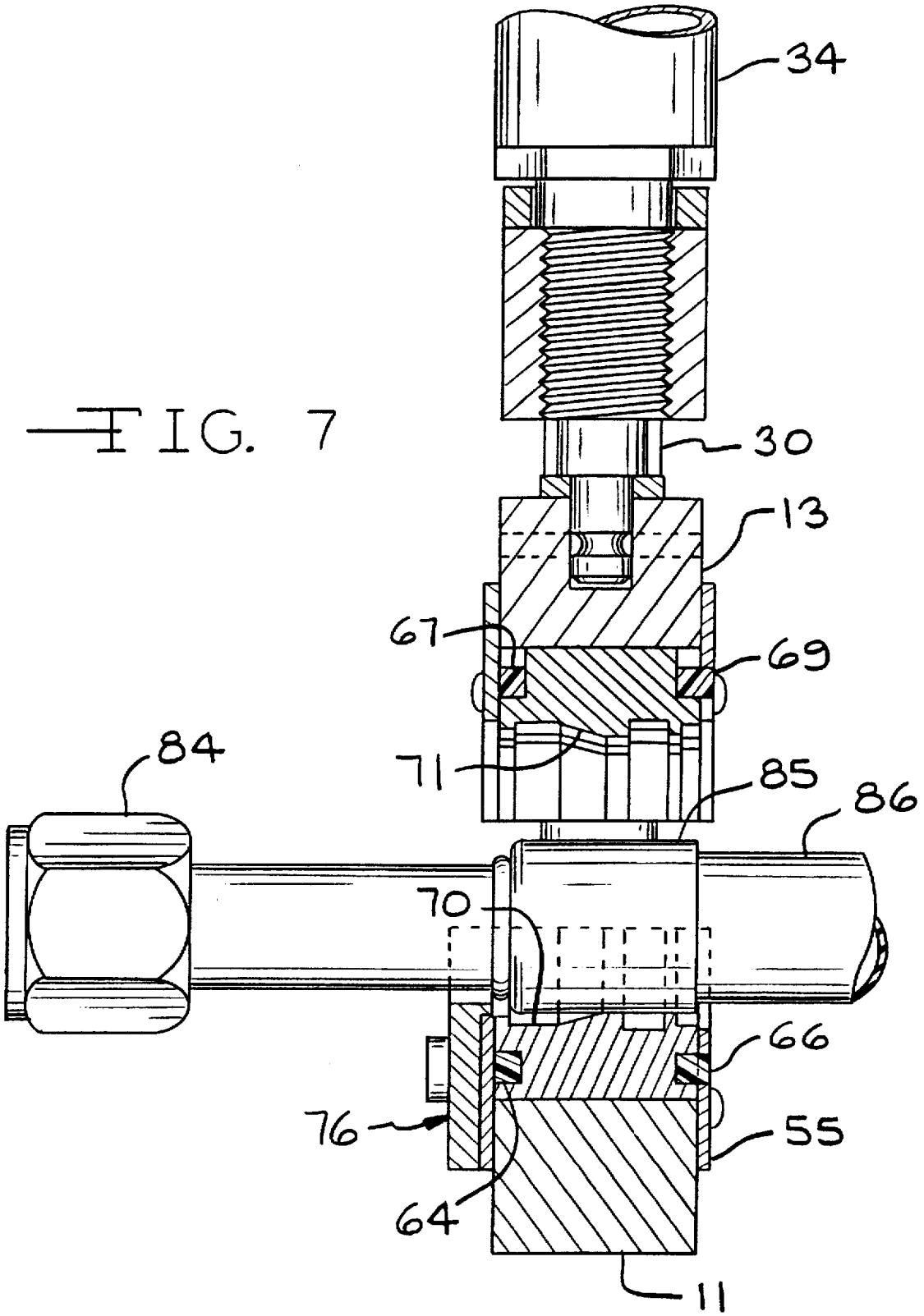
FIG. 7 is a cross-sectional view taken along the line 7—7 of FIG. 1 and showing a fitting ferrule positioned between the movable and stationary die carriages prior to crimping.
Figure 8:
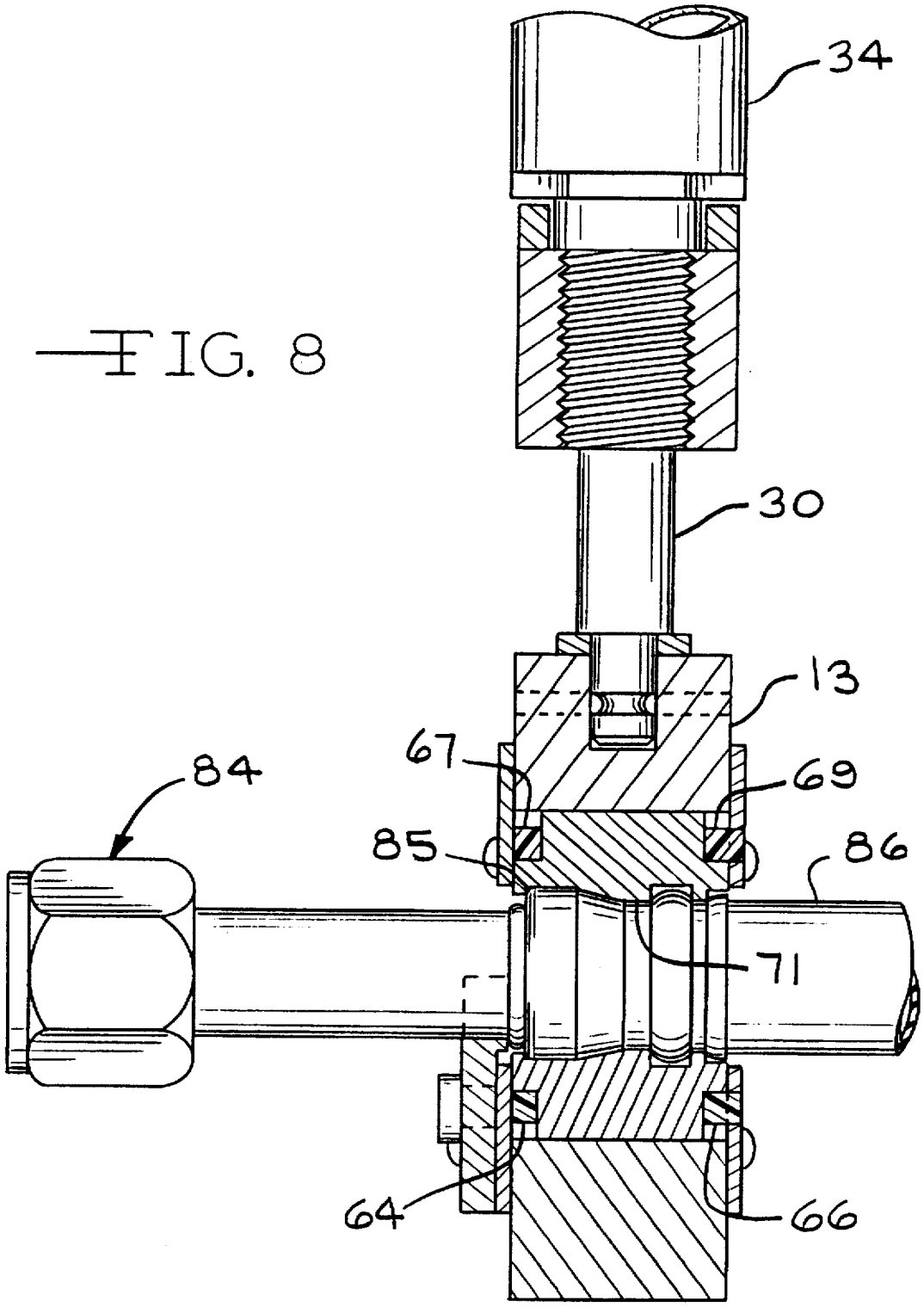
FIG. 8 is a view similar to FIG. 7 showing the ferrule after crimping.

Referring FIGS. 7 and 8, in a normal crimping operation, a workpiece comprising a hose fitting 84 including a ferrule 85 is positioned within the crimper machine 10. The end of a flexible hose 86 is positioned within the ferrule 85. The cylinder 34 is energized. The attached central rod 30 and the connected moveable die carriage 13 is moved downwardly. The die sets 70 and 71 engage the ferrule 85 and crimp the ferrule 85 into a tight sealed relationship with the hose 86, as indicated in FIG. 8. The moveable die carriage 13 is then moved upwardly, the completed crimped hose assembly removed and another cycle begun.

Figure 9:
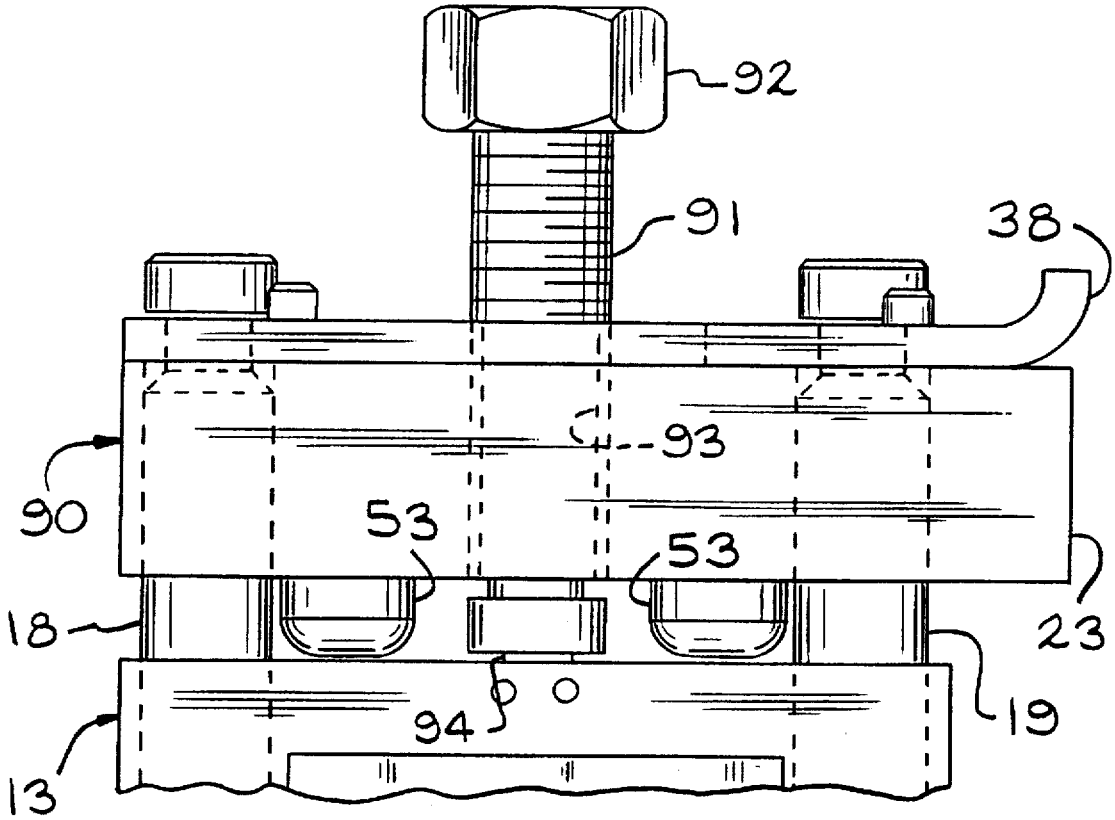
FIG. 9 is a fragmentary front elevational view, similar to FIG. 1 showing another embodiment of a crimper assembly, according to the present invention.
Figure 10:
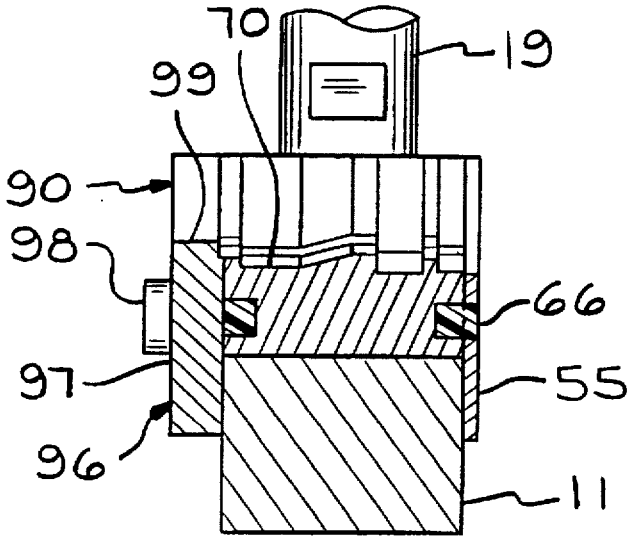
FIG. 10 is a fragmentary view of another embodiment showing a one-piece stop plate adjacent the lower stationary die carriage.

Referring to FIGS. 9 and 10, another embodiment of a crimper machine or crimper assembly 10, according to the present invention, is generally indicated by the reference number 90. In this embodiment, a threaded central rod 91 having a hex head 92 at its upper end is mounted for movement in a threaded opening 93 defined through the press bar 23. A lower end 94 of the central rod 91 is connected to the moveable die carriage 13 as described above with respect to the first embodiment. When the crimping assembly 90 is used, rather than a cylinder operation, as discussed with respect to the crimper assembly 10, an impact wrench is mounted on the hex head 92 and the central rod 91 rotated to move the moveable die carriage 13 downwardly to perform the crimping operation.

Referring to FIG. 10, the crimper assembly 90 includes a one-piece stop plate assembly 96. The stop plate assembly 96 includes a stop plate 97 which is connected to the stationary die carriage 11 by cap screws 98. The stop plate 97 includes a curved portion 99 which supports the workpiece, such as the ferrule of a hose fitting during the crimping operation.

Many revisions may be made to the above-described embodiments without departing from the scope of the present invention or from the following claims.

We claim:

1. A crimping assembly for crimping a fitting ferrule to a hose comprising:

(a) a stationary die carriage having a pocket for receiving crimping die sets; said stationery die carriage defining spaced apart first and second receiving cavities disposed parallel to each other with said pocket disposed therebetween;

(b) a pair of parallel tie rods fixedly supported, one in each of said first and second receiving cavities;

(c) a movable die carriage having spaced apart passageways slidably receiving said tie rods;

(d) a press bar mounted on said tie rods, said press bar having first and second side openings, each receiving one of said tie rods and a central aperture positioned therebetween;

(e) a central rod extending through said central aperture and movable therethrough toward and away from said stationary die carriage, said central rod having an attachment end secured to said movable die carriage;

(f) a first die set retainer plate attached to said stationary die carriage, said first die set retainer plate having a slot, a first flexible die set retainer positioned in said stationary die carriage adjacent said first die set retainer plate, said first flexible die set retainer having a tongue received in said plate slot and crimping die sets received in said first flexible die set retainer; and (g) a second die set retainer plate attached to said movable die carriage, said second die set retainer plate having a slot, a second flexible die set retainer positioned in said movable die carriage adjacent said second die set retainer plate, said second flexible die set retainer having a tongue received in said plate slot and crimping die sets received in said second flexible die set retainer.

2. A crimper assembly, according to claim 1, wherein one of said pair of parallel tie rods has a first diameter and the other one of said pair of parallel tie rods has a different diameter.

3. A crimper assembly, according to claim 1, including a disconnect plate slidably mounted adjacent said press bar, said tie rods having reduced diameter portions adjacent said disconnect plate, said disconnect plate defining first openings complementary with said reduced diameters and second larger openings adjacent said first openings, wherein said disconnect plate can be moved relative to said press bar thereby aligning said tie rods with said second larger openings whereby said press bar and said movable die carriage can be moved away from said stationary die carriage.

4. A crimper assembly, according to claim 3, and a spring assembly operatively connected between said disconnect plate and said press bar urging said disconnect plate to a position wherein said first openings are aligned with said reduced diameters of said tie rods.

5. A crimper assembly, according to claim 3, including at least one elastomeric bumper mounted on said press bar, wherein said bumper is engaged by said movable die carriage when it moves relatively toward said press bar.

6. A crimper assembly, according to claim 1, including a cylinder operatively connected to said central rod.

7. A crimper assembly, according to claim 1, wherein said central aperture of said press bar is a threaded aperture and wherein said central rod has threads which are received by said central aperture, said central rod having a hex head for engagement by a tool.

8. A crimper assembly, according to claim 1, including a stop plate assembly mounted on said stationary die carriage in opposed relationship to said first die set retainer plate.

9. A crimper assembly, according to claim 8, wherein said stop plate assembly includes an inner plate and an outer plate, said outer plate defining a curved portion for supporting a workpiece.

* * * * *